US008241016B2

(12) United States Patent
Laufer et al.

(10) Patent No.: US 8,241,016 B2
(45) Date of Patent: Aug. 14, 2012

(54) FLUID TRANSPORTING DEVICE

(75) Inventors: Wolfgang Laufer, Aichhalden (DE); Siegfried Seidler, Villingen-Schwenningen (DE)

(73) Assignee: EBM-Papst St. Georgen GmbH & Co. KG, St. Georgen (DE)

( * ) Notice: Subject to any disclaimer, the term of this patent is extended or adjusted under 35 U.S.C. 154(b) by 1000 days.

(21) Appl. No.: 11/574,882

(22) PCT Filed: Jul. 16, 2005

(86) PCT No.: PCT/EP2005/007772

§ 371 (c)(1), (2), (4) Date: Sep. 18, 2008

(87) PCT Pub. No.: WO2006/027043

PCT Pub. Date: Mar. 16, 2006

(65) Prior Publication Data

US 2009/0010769 A1 Jan. 8, 2009

(30) Foreign Application Priority Data

Sep. 10, 2004 (DE) ..... 20 2004 014 417 U

(51) Int. Cl.

| | |
|---|---|
| ***F04B 35/04*** | (2006.01) |
| ***F04B 23/14*** | (2006.01) |
| ***H02K 49/00*** | (2006.01) |
| ***H02K 49/10*** | (2006.01) |

(52) U.S. Cl. ..... 417/420; 417/201; 417/423.1; 417/423.7; 310/103; 310/104

(58) Field of Classification Search ..... 310/103, 310/104; 417/201, 420, 423.7, 423.1; 415/60, 415/10

See application file for complete search history.

(56) References Cited

U.S. PATENT DOCUMENTS

| | | | | |
|---|---|---|---|---|
| 4,752,194 | A * | 6/1988 | Wienen et al. | 417/420 |
| 4,780,066 | A * | 10/1988 | Bolleter et al. | 417/420 |
| 7,509,999 | B2 | 3/2009 | Angelis et al. | 165/247 |
| 7,582,997 | B2 * | 9/2009 | Rojo Lulic | 310/103 |
| 2005/0099077 | A1 | 5/2005 | Gerfast | 310/4 |
| 2007/0075597 | A1 * | 4/2007 | Seidler et al. | 310/67 R |
| 2008/0038126 | A1 * | 2/2008 | Berroth | 417/420 |

FOREIGN PATENT DOCUMENTS

DE 42 38 132 C2 5/1994

(Continued)

*Primary Examiner* — Mariceli Santiago

(74) *Attorney, Agent, or Firm* — Milton Oliver, Esq.; Oliver Intellectual Property LLC

(57) ABSTRACT

An arrangement for conveying fluids has a fluid pump (91) implemented in the manner of a centrifugal pump, having a pump wheel (90) that is connected to a first permanent magnet (92). The arrangement further has an electronically commutated internal-rotor motor (70) having a stator (68), inside which stator is rotatably arranged a rotor (60) that is in turn connected to a second permanent magnet (76; 140) that coacts with the first permanent magnet (92) in the manner of a magnetic coupling (93). The arrangement also has a partitioning can (52) that separates the first permanent magnet (92) of the magnetic coupling (93), which magnet is arranged inside said partitioning can (52), in fluid-tight fashion from the second permanent magnet (76; 140) arranged outside the partitioning can (52), the stator (68) of the internal-rotor motor (70) being arranged substantially in the same drive plane as the magnetic coupling (93) and radially outside the latter.

33 Claims, 11 Drawing Sheets

FOREIGN PATENT DOCUMENTS

| | | | |
|---|---|---|---|
| DE | 297 16 109 | U1 | 2/1999 |
| DE | 203 11 701 | U1 | 1/2004 |
| DE | 103 44 699 | A1 | 4/2004 |
| WO | WO 2004-031588 | A | 4/2004 |
| WO | WO 2004/031588 | A1 | 4/2004 |

* cited by examiner

FIG..10

FLUID TRANSPORTING DEVICE

CROSS-REFERENCE

This application is a section 371 of PCT/EP2005/007772, filed 16 Jul. 2005 and published 16 Mar. 2006 as WO 2006/27043-A1 and further claims priority from German application DE 20 2004 014 417.4, filed 10 Sep. 2004, both of which are hereby incorporated by reference.

FIELD OF THE INVENTION

The invention relates to an arrangement for conveying fluids. As fluids, liquid and/or gaseous media can be conveyed.

BACKGROUND

In computers in particular, components having high heat flux densities (e.g. 60 W/cm$^2$) are in use today. The heat from these components must first be transferred into a liquid circulation system, and from there the heat must be discharged to the ambient air via a liquid/air heat exchanger.

Dissipation of heat from components having a high heat flux density is accomplished by means of so-called heat absorbers or cold plates. In these, heat is transferred to a cooling liquid, and this cooling liquid is usually forced to circulate in a circulation system.

In this context, the cooling liquid flows not only through the heat absorber but also through a liquid pump that produces the forced circulation and produces an appropriate pressure buildup and appropriate volumetric flow through the heat absorber and an associated heat exchanger, so that the relevant heat transfer coefficients become large and the temperature gradients necessary for heat transfer become small.

A fan is usually arranged on the heat exchanger, which fan produces, on the air side of the heat exchanger, a forced convection of the cooling air as well as good transfer coefficients.

In cooling arrangements of this kind, the fan and the liquid pump are driven separately, and these components are also often physically separate from one another. Two drives are therefore required, which in most cases operate rotationally. These drives require energy and also a fairly large installation space, both of which are undesirable.

SUMMARY OF THE INVENTION

It is therefore an object of the invention to make available a novel arrangement, for conveying fluids, which conserves both energy and space.

According to the invention, this object is achieved by connecting a pump wheel to a first permanent magnet, providing a "partitioning can" hermetically separating the pump from electrical drive components but permitting magnetic coupling of the pump's permanent magnet to a second permanent magnet, forming part of a driving internal-rotor electric motor, whose stator is arranged radially surrounding the magnetic coupling components. A very compact arrangement with good efficiency is thereby obtained, since the internal-rotor motor and the magnetic coupling of the fluid pump are, so to speak, nested inside one another.

Another manner of achieving the stated object is to use the rotor of the internal-rotor motor to directly drive a fan wheel and to indirectly drive, via the magnetic coupling, the rotor of a centrifugal pump having a radially extending outlet conduit, which conduit also serves as part of a mechanical connection between the partitioning can and a surrounding, generally cylindrical, air-directing housing. This enables particularly good integration of the components of the arrangement, since the electric motor, fluid pump, fan wheel, and air-directing housing are assembled together in enormously compact fashion.

BRIEF FIGURE DESCRIPTION

Further details and advantageous refinements of the invention are evident from the exemplifying embodiments, in no way to be understood as a limitation of the invention, that are described below and depicted in the drawings.

DETAILED DESCRIPTION

Figure 1:
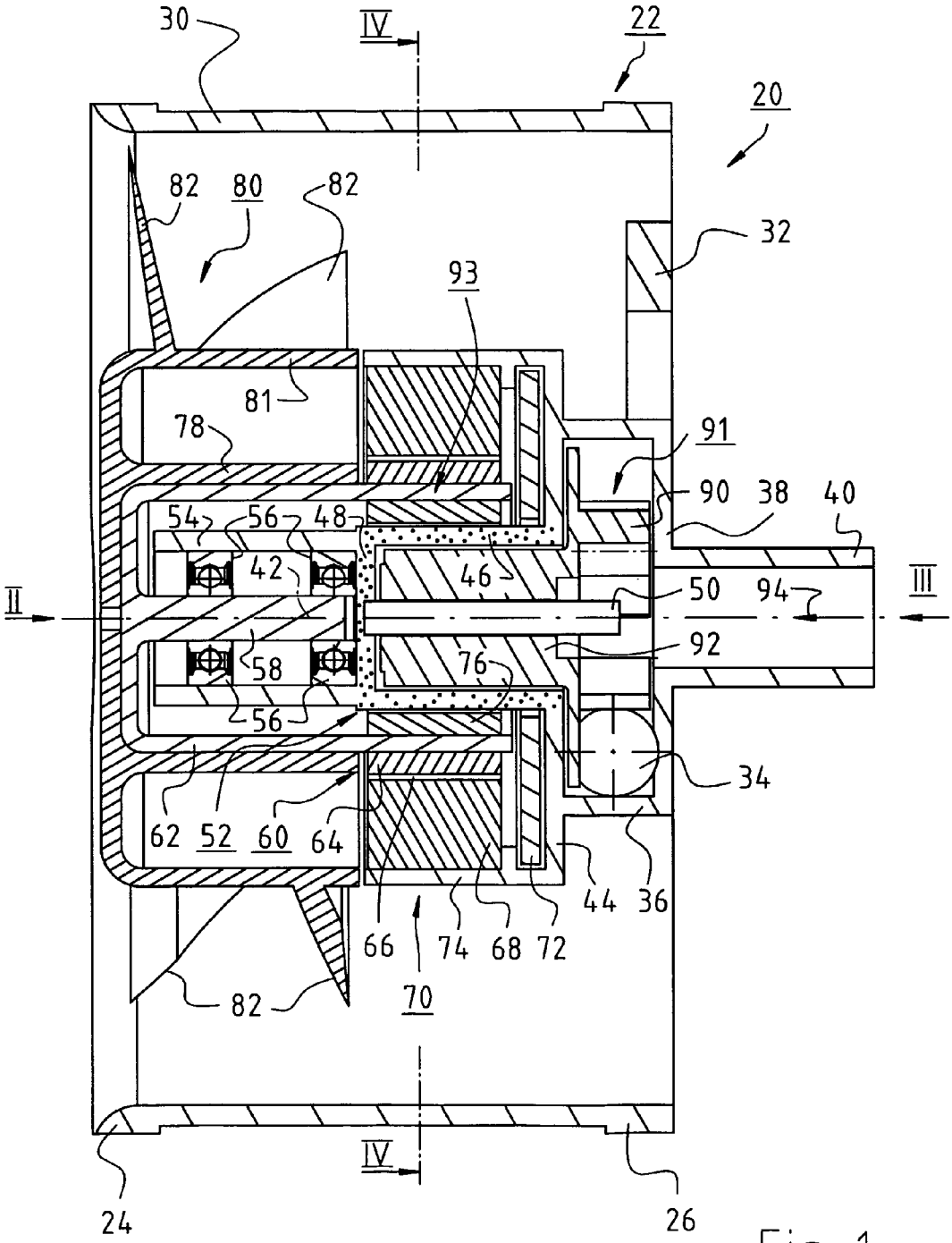
FIG. 1 is a longitudinal section through a preferred exemplifying embodiment of an arrangement according to the present invention, viewed along line I-I of FIG. 2.
Figure 2:
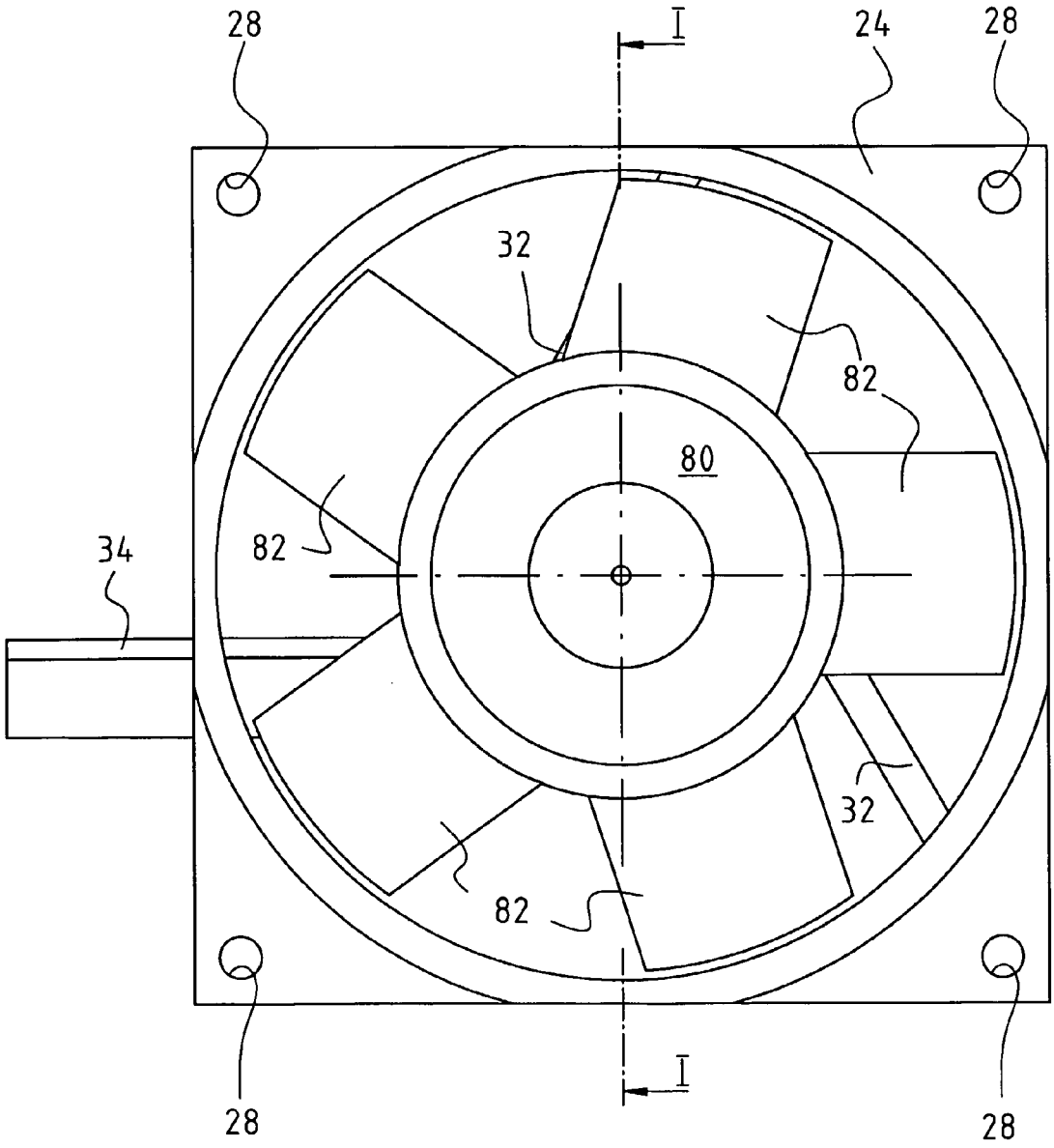
FIG. 2 is a plan view of the fan-side end of the arrangement, viewed in the direction of arrow II of FIG. 1.

FIG. 1 is a longitudinal section through an arrangement 20 according to the present invention. Said arrangement has externally an approximately cylindrical fan housing 22 having two flanges 24, 26 (FIGS. 5 and 6), at each of whose corners a mounting hole 28 is located, and which flanges are connected to one another by a tubular part 30.

Figure 3:
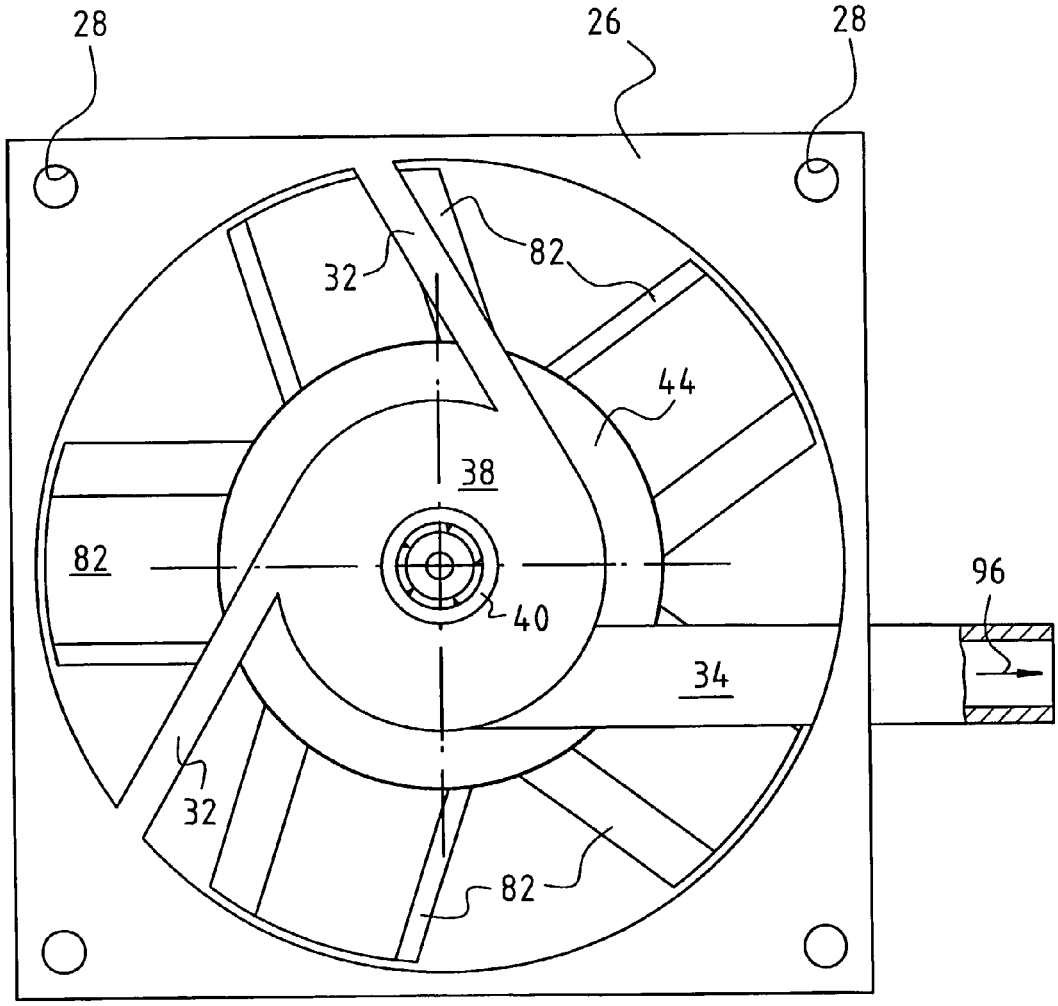
FIG. 3 is a plan view of the pump-side end of the arrangement, viewed in the direction of arrow III of FIG. 1.
Figure 5:
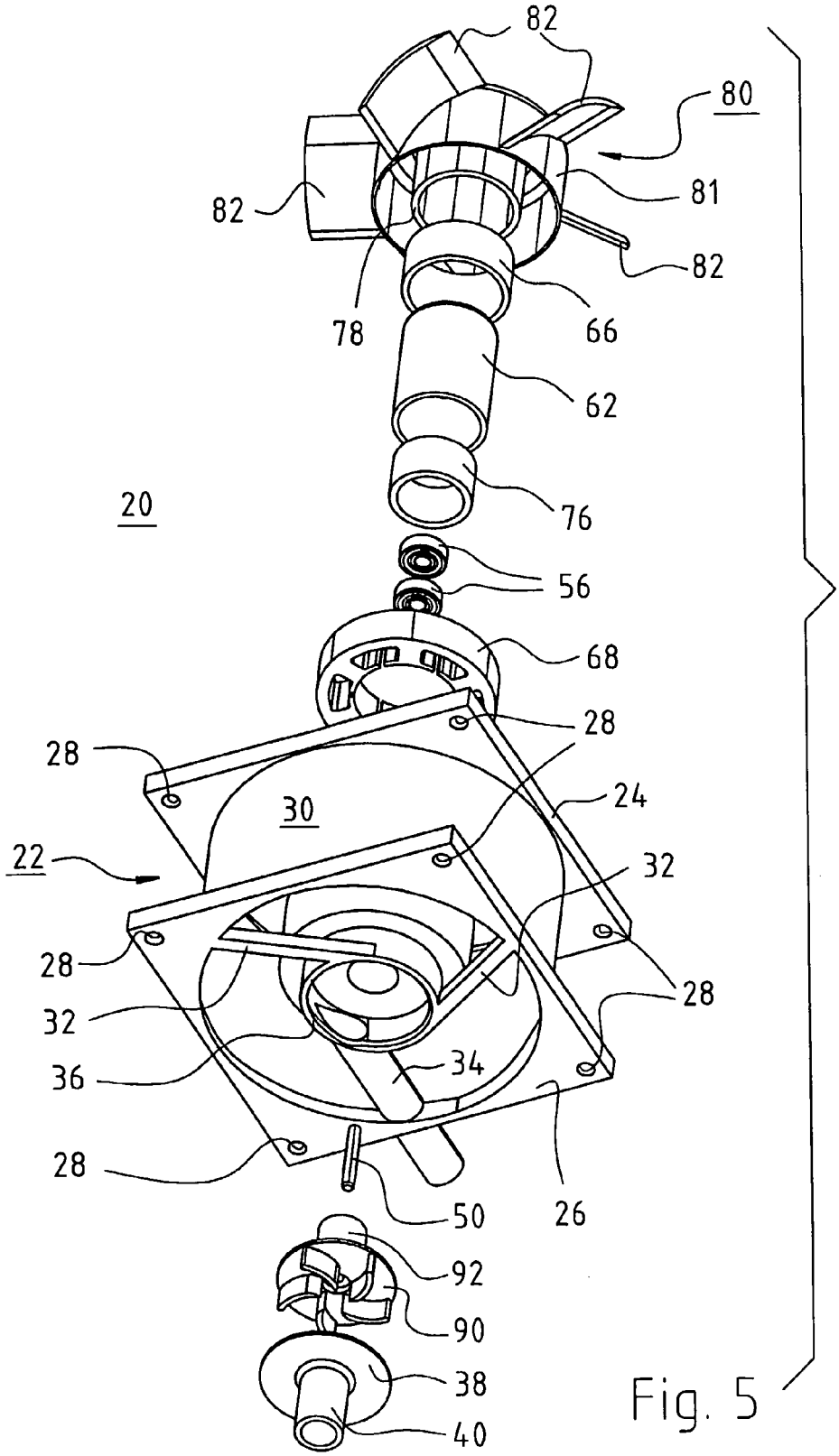
FIG. 5 is a first exploded depiction of the arrangement according to FIGS. 1 to 4, viewed from the pump side.
Figure 6:
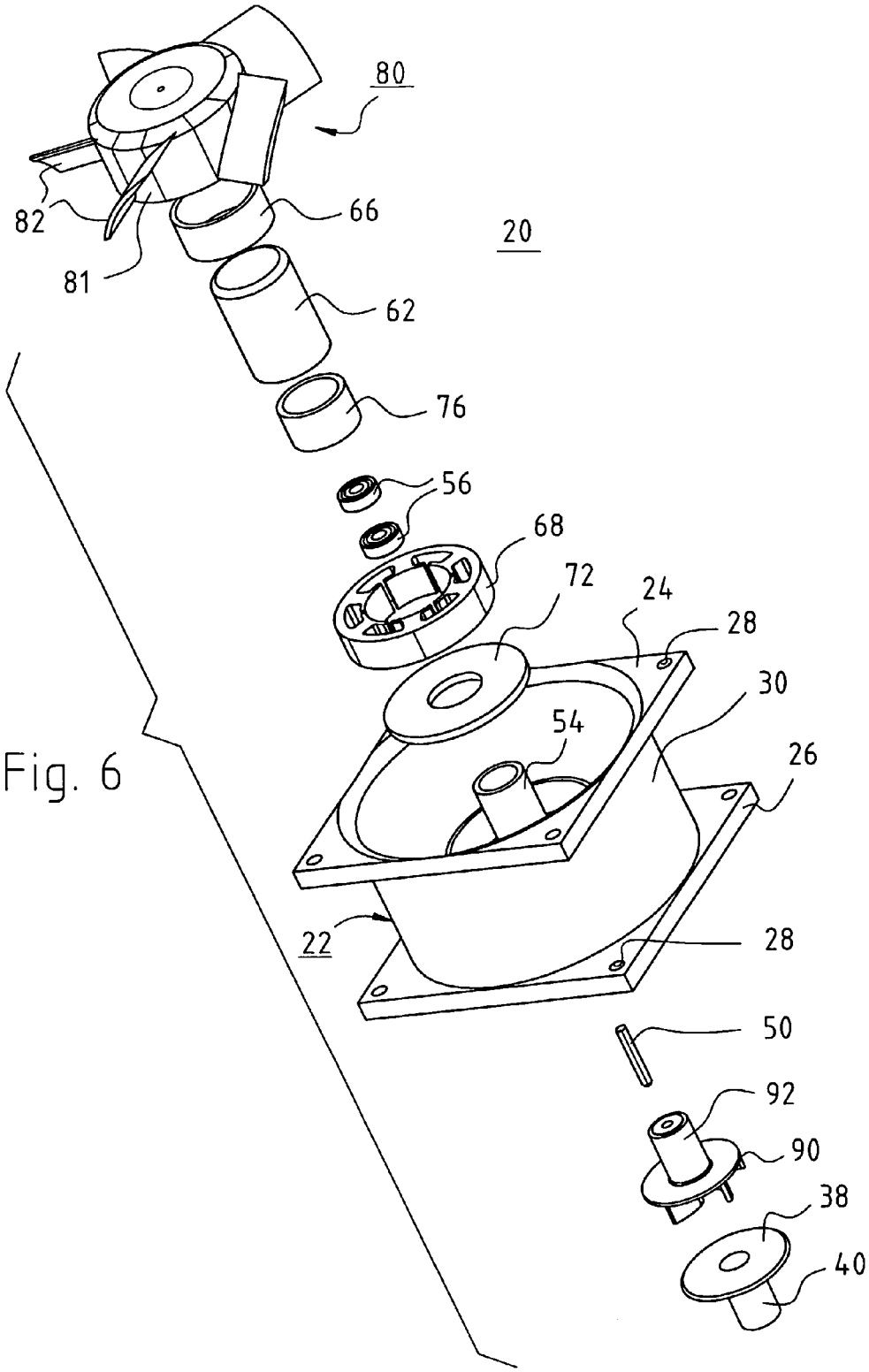
FIG. 6 is a second exploded depiction of the arrangement according to FIGS. 1 to 4, viewed from the fan side.

According to FIGS. 3 and 5, flange 26 is connected, by means of two obliquely extending struts or spokes 32 and by means of a sub-portion of an outlet fitting 34, to cylindrical part 36 of a pump housing that, in the completed state, is closed off by a cover 38 on which an inlet tube 40 is located. Cover 38 can be connected, for example by an adhesive connection, by plastic welding, or by means of an O-ring seal, in liquid-tight fashion to part 36.

Part 36 transitions, on its left side in FIG. 1, into a portion 44 extending perpendicular to a rotation axis 42, which portion transitions on its radially inner side into a cylindrical partitioning tube 46. At its left end in FIG. 1, partitioning tube 46 is closed off by a portion 48 on which is mounted, in suitable fashion, a shaft 50 protruding to the right in the direction of rotation axis 42. Partitioning tube 46 and portion 48 together form a so-called partitioning can 52 that is highlighted in gray in FIG. 1. This partitioning can also have a different geometrical shape than the one depicted in FIG. 1.

A partitioning tube or partitioning can is understood, in electrical engineering, to be a component made of a nonmagnetic material, e.g. plastic or stainless steel, which extends through at least a part of the air gap of a magnetic circuit and there forms a fluid barrier.

Adjoining portion 48 is a bearing tube 54 in which shaft 58 of an internal rotor 60 is journaled by means of two roller bearings 56. Shaft 58 is mounted on a cup-like carrier part 62 made of soft ferromagnetic material, on whose outer side is mounted a permanent ring magnet 64 that can be magnetized, for example, with four poles. This ring magnet 64 is separated by an air gap 66 from stator 68 of an electronically commutated internal-rotor motor (ECM) 70, associated with which is a circuit board 72 having electronic components (not shown), which circuit board extends parallel to portion 44 and, with reference to FIG. 1, to the left thereof.

Figure 4:
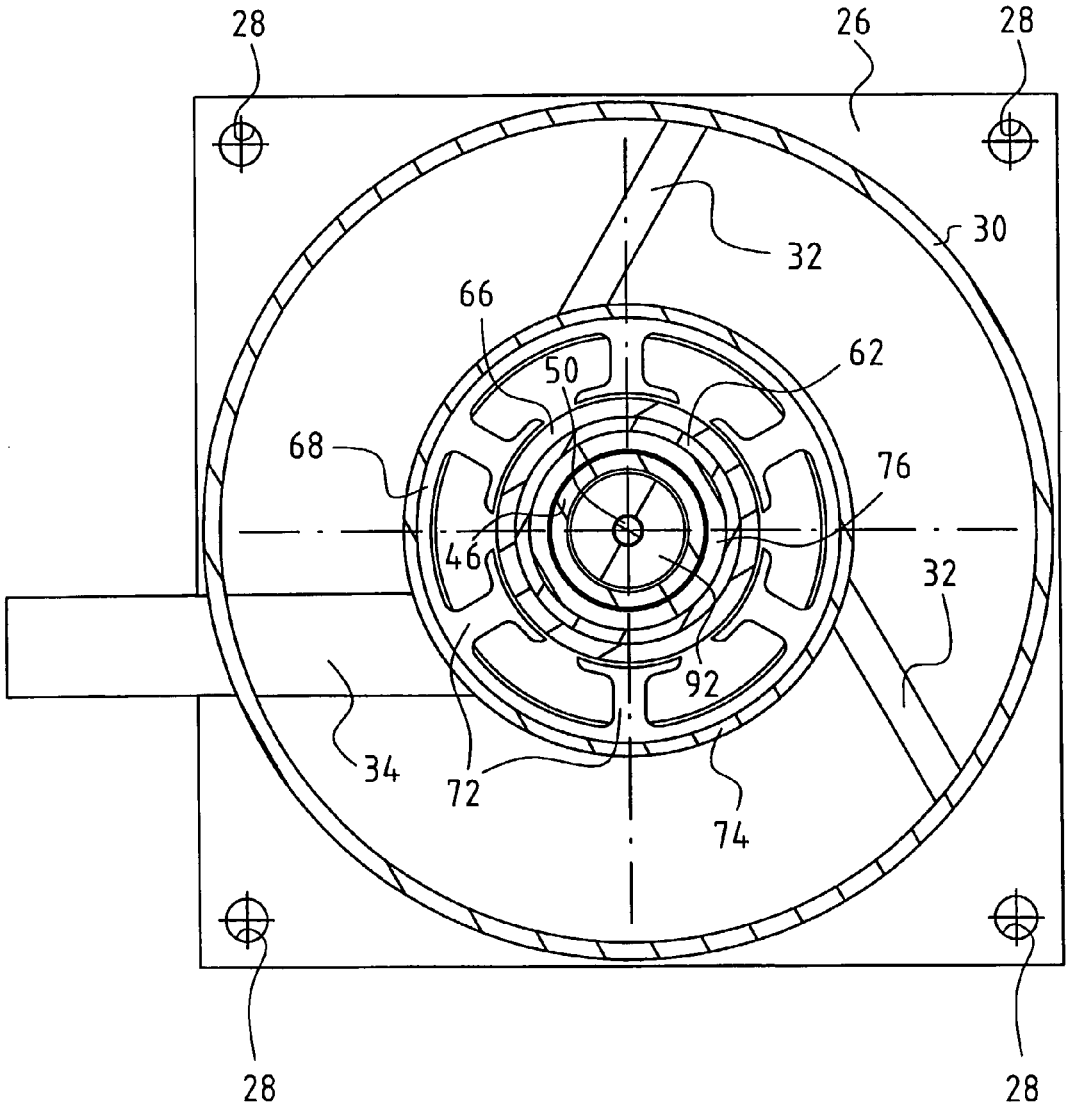
FIG. 4 is a section viewed along line IV-IV of FIG. 1.

FIG. 4 shows, by way of example, the configuration of stator 68 having a total of six salient poles 76, whose windings are not depicted. As is known to one skilled in the art, a three-phase design is preferred for generation of a sufficiently large and uniform torque. Experiments have shown, however, that even electronically commutated motors having a simpler drive design are quite suitable. Such simpler motors are often referred to as single-phase motors.

Stator 68 is mounted on the inner side of a cylindrical portion 74 that preferably is implemented integrally with portion 44.

Approximately opposite ring magnet 64, a ring magnet 76 is mounted on the inner side of carrier part 62. During operation, the latter magnet rotates around partitioning can 52.

A fan wheel 80, which can be implemented e.g. as an axial, diagonal, or radial fan wheel, is mounted on cup-like carrier part 62 by means of a cup-like portion 78. Said fan wheel has an approximately cylindrical outer part 81 whose outside diameter corresponds to that of cylindrical portion 74, and fan blades 82 are arranged on said part 81 in the manner depicted (cf. FIGS. 5 and 6). During operation, blades 82 rotate inside cylindrical portion 30 of fan housing 22 and convey air through said portion 30.

A pump wheel 90 of a centrifugal pump or other hydraulic machine 91 is mounted rotatably on shaft 50, said wheel preferably being implemented integrally with a plastic-matrix first permanent magnet 92. The latter preferably has the same number of magnetic poles as ring magnet 76 (which hereinafter will also be referred to as a second permanent magnet) and forms with the latter a magnetic coupling 93 that transfers the torque generated by motor 70 through partitioning can 52 to pump wheel 90, and thereby drives the latter at the rotation speed of internal rotor 60.

During operation, liquid is thereby taken in through fitting 40 in the direction of an arrow 94, and conveyed in the direction of an arrow 96 through outlet fitting 34.

Rotor 60 thus drives both fan wheel 80 via a direct mechanical coupling, and pump wheel 90 via magnetic coupling 93.

It is very advantageous (because of the space saved) that motor 70 and magnetic coupling 93 lie in the same drive plane, magnet 92 of pump wheel 90 being the innermost rotating element. This allows the diameter of magnet 92 to be made as small as is tolerable given the torque to be transferred.

Because magnet 92 rotates directly in the pumped fluid, the fluid immediately adjacent to it adheres directly to it and moves at the same circumferential speed. This fluid likewise adheres at the interface to the stationary partitioning can 52, and is thus at a standstill there. A continuous speed gradient exists between these two extreme values. The fluid in the gap between first magnet 90 and stationary housing 52 is thus exposed to shear stresses. The viscosity of the fluid results in frictional losses. These are governed by the diameter of the rotating surfaces, the square of which affects the frictional torque. The frictional power dissipation thus increases as the cube of the diameter ($D^3$) of the rotating surfaces, and can be minimized in the context of the present invention.

The design that is depicted and described enables very high efficiency for a pump of this kind that is driven via a magnetic coupling 93, since the rotating surfaces on first magnet 92 can be made small. The minimum possible diameter is determined, as already stated, by the torque that must be transferred by magnetic coupling 93. If the diameter were made even smaller, this would result in a decrease in the pump's power level, i.e. in the context of an arrangement according to the present invention, the magnetic coupling can be designed so that very good efficiency is obtained at the working point.

Further optimization is possible by using particularly high-grade magnetic materials for permanent magnets 76 and 92. The diameter of the rotating surfaces can thereby be further reduced, resulting in especially high efficiency; costs, are however, correspondingly increased.

Assembly (FIGS. 1 to 6)

Firstly pump wheel 90 is placed onto shaft 50, and cylindrical part 36 is then closed off in liquid-tight fashion by cover 38.

The journaling of pump wheel 90 is accomplished usually with plain bearings, although other bearings are also possible. Pump wheel 90 is retained by a magnetic pull, i.e. the attraction between magnets 76 and 92, and can additionally be mechanically secured, for example by snap rings, thrust washers, etc.

Circuit board 72 and stator 68 are installed inside cylindrical portion 74. Shaft 58 of cup-shaped part 62, on which part magnets 64 and 76 as well as fan wheel 80 are installed, is then installed in bearing tube 54 by means of bearings 56.

Fan wheel 80 can already be balanced prior to assembly, or also when it is already installed in the arrangement.

Figure 7:
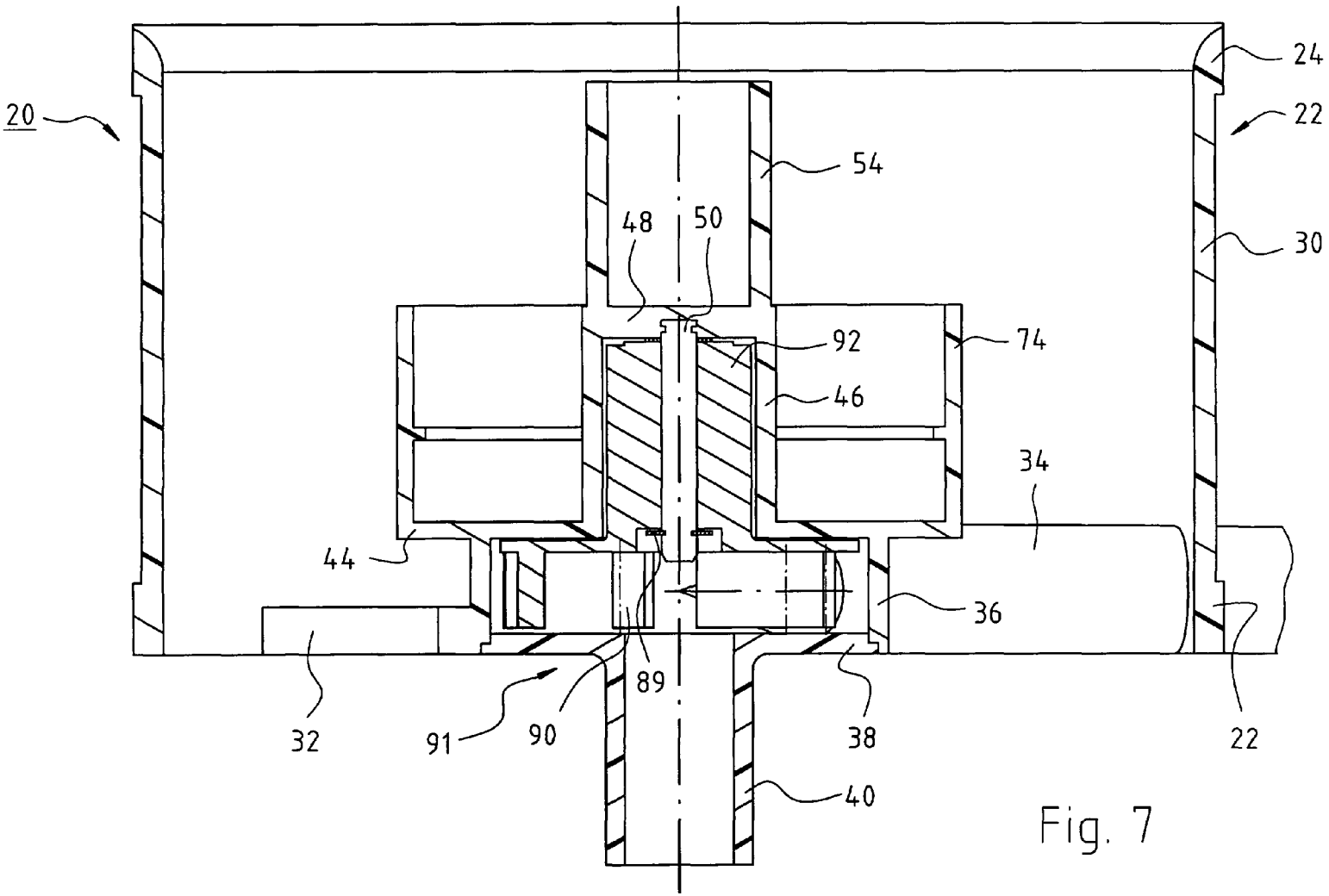
FIG. 7 is a section through the housing of the arrangement, in which only the pump wheel of the centrifugal pump, and a manner in which it is mounted, are depicted.
Figure 8:
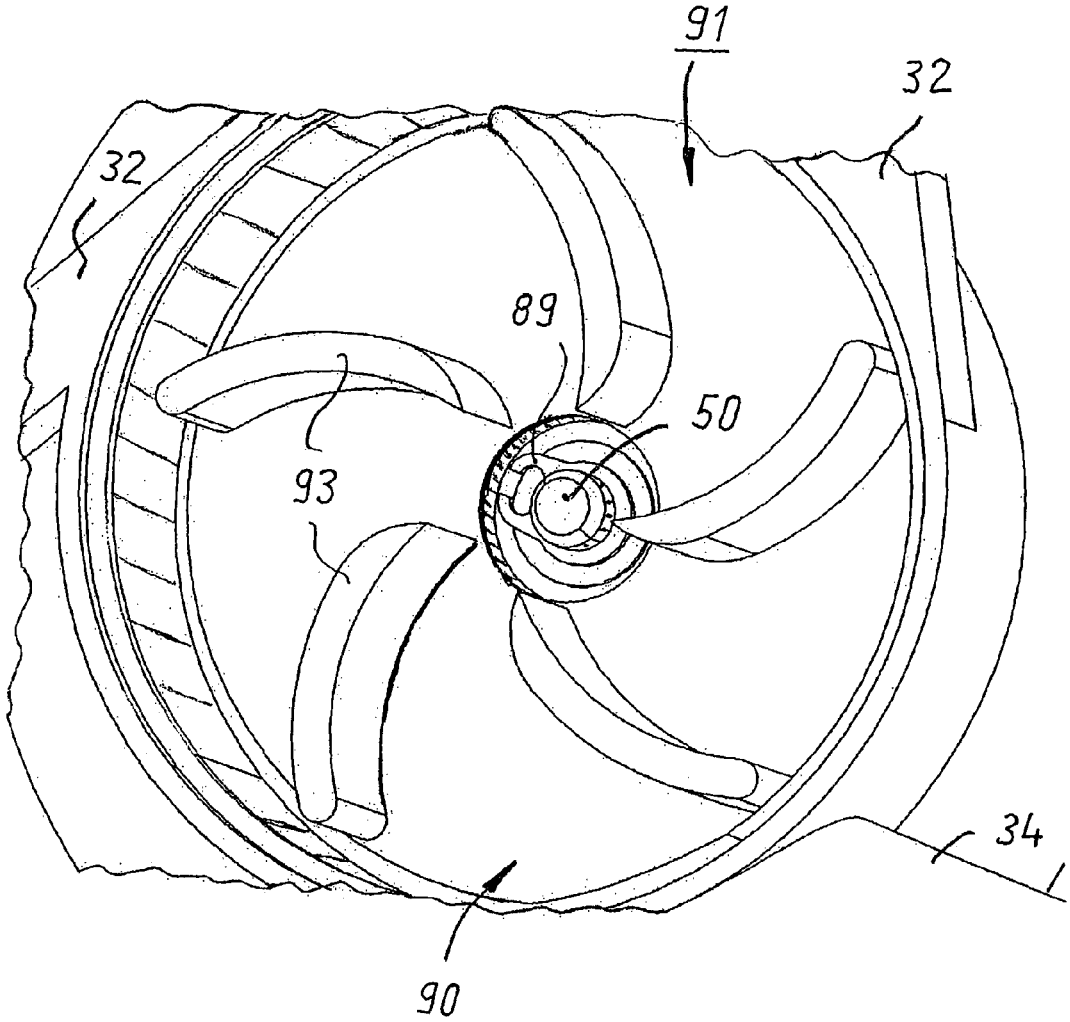
FIG. 8 is a perspective depiction analogous to FIG. 7 that likewise shows the mounting of the pump wheel of the centrifugal pump and a preferred configuration of said pump wheel.

FIG. 7 and FIG. 8 show, in a variant, the housing of arrangement 20. Shaft 50 of pump wheel 90 is mounted in portion 48. Said shaft has, at its free end, an annular groove in which is mounted a snap ring 89 that retains pump wheel 90 on shaft 50 and at the same time constitutes an axial bearing for pump wheel 90. FIG. 8 also shows a preferred shape of blades 93 of pump wheel 90 of hydraulic machine 91.

Figure 9:
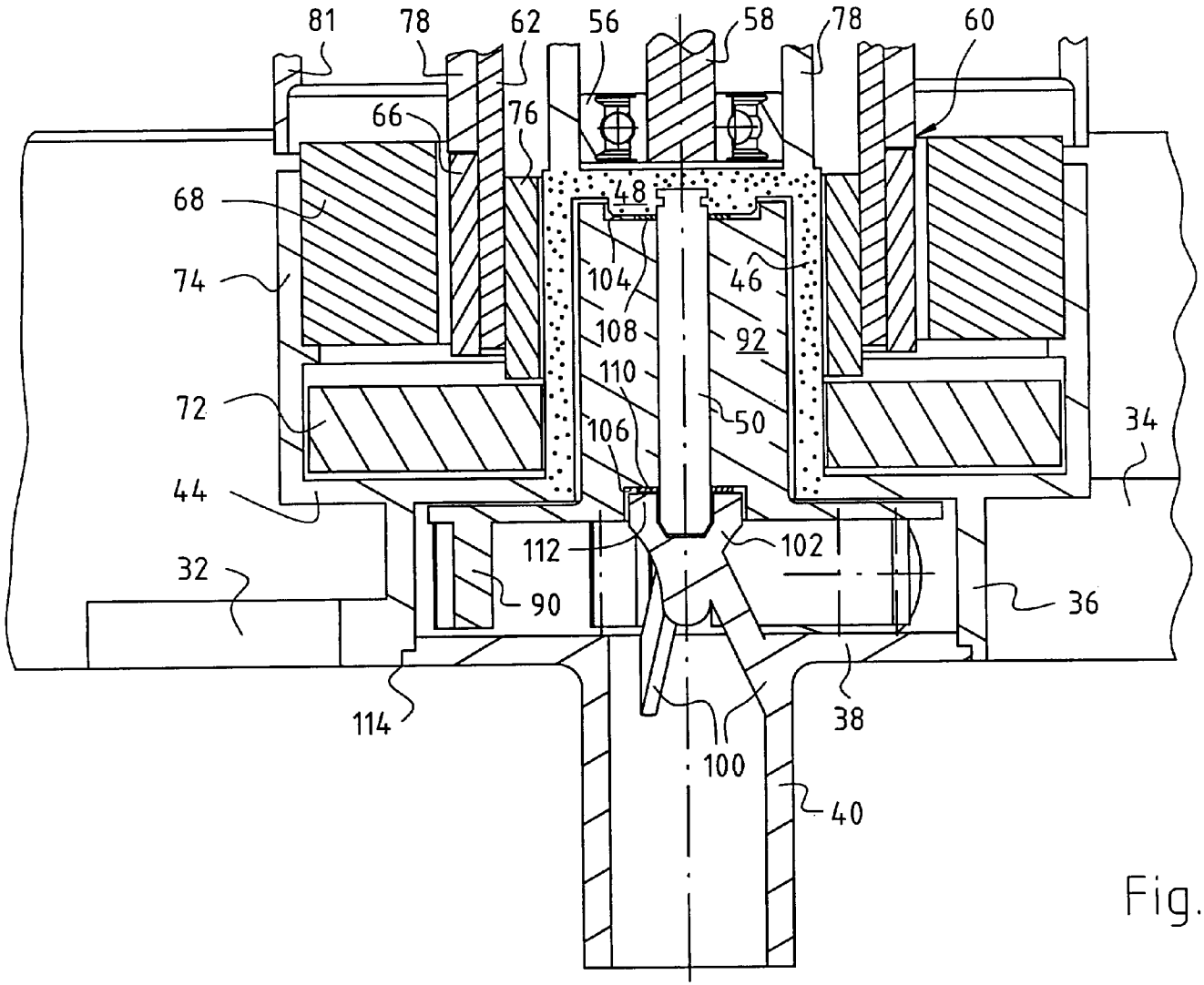
FIG. 9 shows a variant of the preceding figures in which a separate component that is arranged in the inflow fitting is provided for axial journaling of the pump wheel.

FIG. 9 is a greatly enlarged depiction of a second variant approximately analogous to what is depicted in FIG. 1. Identical or identically functioning parts are also labeled here with the same reference characters and are not described again. The shape of the housing is largely the same as in FIG. 8.

In this case a retaining shell 102, which in the assembled state fits over and braces the free end of shaft 50, is mounted in inflow 40 by means of three supporting legs 100, only two of which are visible in FIG. 9. Supporting legs 100 do not impede the flow of cooling fluid through inflow 40. They are implemented integrally with said inflow.

First magnet 92 here has depressions 104, 106 at both ends. Arranged in each of these depressions is a respective thrust washer 108, 110, of which washer 108 is arranged between portion 48 and depression 104. The other washer 110 is arranged between a raised rim 112 of bearing shell 102 and depression 106. Pump rotor 90 is thereby also securely axially journaled on shaft 50.

Circuit board 72 is shown in FIG. 9 as being thicker than in FIG. 1. This depends on how long second permanent magnet 76 must be in order to be able to transfer the desired torque from rotor 60 to first magnet 92. With the use of suitable magnet materials, it is possible to keep the overall axial length of the arrangement very short. Alternatively, circuit board 72 can be arranged laterally on air-directing housing 22.

Upon assembly, firstly pump wheel 92 is placed onto shaft 50, and then part 38, 40 having bearing shell 102 is installed in the manner depicted. Part 38, 40 can be connected in liquid-tight fashion to portion 36 of the pump housing by, for example, laser welding in the region of a parting line 114. A journaling system that is very secure and long-lived, and in which rattling of pump wheel 90 is reliably prevented, is thereby obtained.

Figure 10:
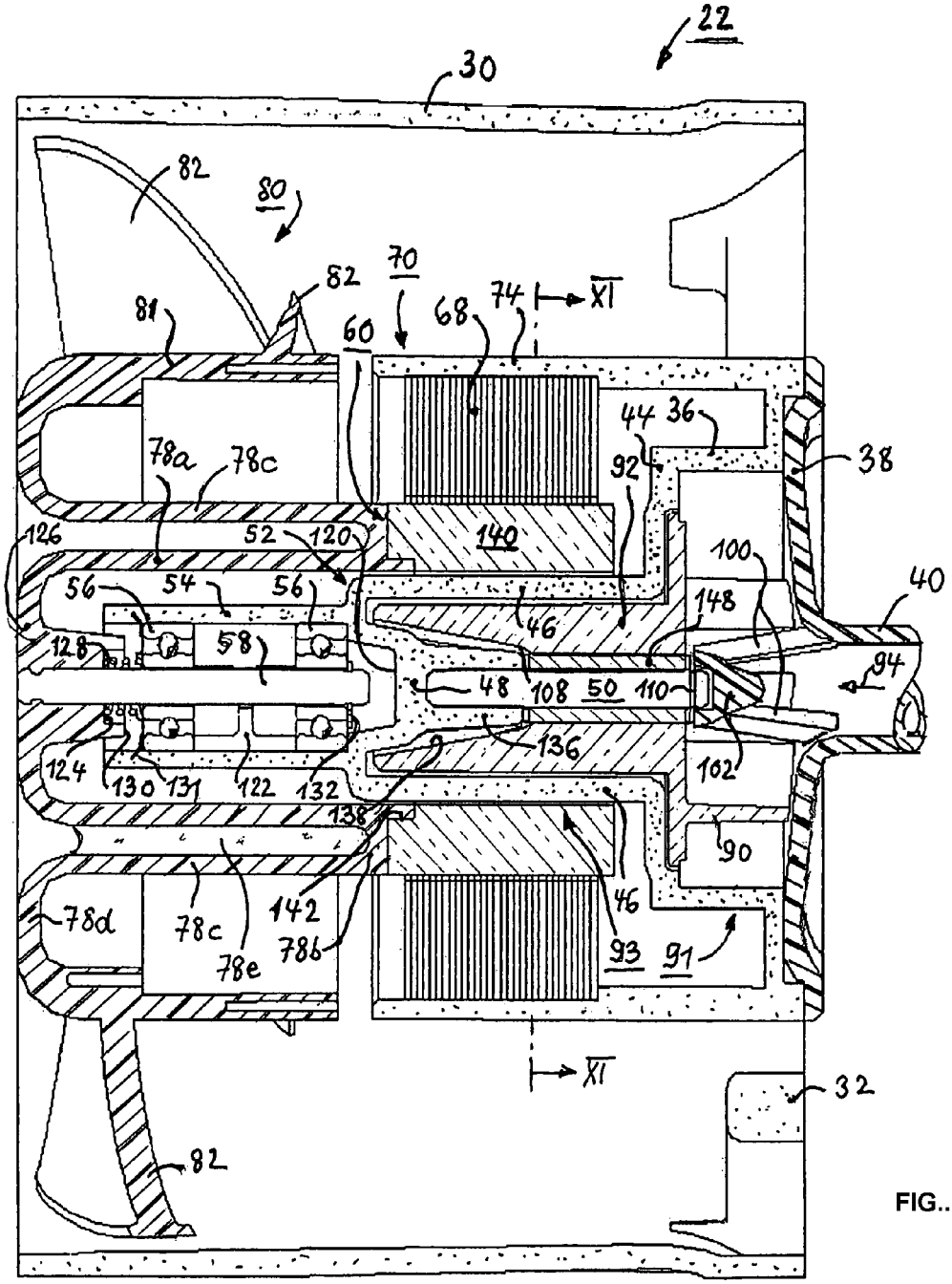
FIG. 10 shows a third variant of the preceding figures in which the configuration of the rotor magnet and of the magnetic coupling is simplified as compared with FIG. 9.

FIG. 10 is an enlarged depiction of a third, even further optimized variant of the invention. This depiction is largely analogous to the depiction according to FIG. 9. Identical or identically functioning parts are also labeled here with the same reference characters and are not described again. The shapes of housing 22 and of fan wheel 80 correspond largely to those in FIG. 1. The circuit board of ECM 70 is not depicted. Said board can be located at the same location as circuit board 72 of FIG. 9, but it can also be arranged laterally on housing 22. The latter variant can sometimes be advantageous for space reasons.

Shaft 58, which journals rotor 60 of ECM 70 and fan wheel 80, is here again journaled by means of two ball bearings 56 in a bearing tube 54 that is implemented integrally with partitioning can 52. The cavity of bearing tube 54 continues to the right in FIG. 10 into a recess 120 that is necessary, in this preferred embodiment, for the installation of shaft 58 and ball bearings 56.

A spacing member 122 is located between the outer rings of ball bearings 56. Shaft 58 is displaceable in the inner rings of the two ball bearings 56. Located between the inner ring of the left ball bearing 56 and a depression 124 of rotor hub 126 is a compression spring 128 that is compressed upon installation of shaft 58, the right end of shaft 58 being briefly displaced into recess 120, which therefore needs to be provided only because of this special installation method. This rightward displacement of shaft 58 is produced by a corresponding rightward displacement of fan wheel 80.

Hub 126 has, for this purpose, an axial projection 130 with which, in the context of this displacement, it pushes against the left side of a latching member 131 and via said member against the left side of the left ball bearing 56, and thereby presses the outer rings of the two ball bearings 56 into bearing tube 54. Fan wheel 80 is then automatically displaced by the compressed spring 128 back to the left into the final position that is shown, in which context a snap ring 132 at the right end of shaft 58 abuts against the right side of the inner ring of the left ball bearing 56. In the context of this operation, latching member 131 latches into the inner wall of bearing tube 54 in the manner depicted, and thus retains ball bearings 56 in bearing tube 54.

The left end of shaft 50 is mounted in an axial projection 136 of partitioning can 52, which projection protrudes into an opening 138, complementary thereto, of magnet 92 of magnetic coupling 93.

Fan wheel 80 is manufactured from plastic, and its hub 126 is mounted by plastic injection molding, in the manner depicted, on shaft 58.

From this hub 126, a first cylindrical portion 78*a* extends to the right in FIG. 10 and is connected at its right end, in suitable fashion, to a ring magnet 140 whose preferred magnetization is depicted, schematically and in enlarged fashion, for a four-pole version.

This magnetization has four so-called interpolar gaps 142, i.e. in normal circumstances there are no physical interruptions in ring magnet 140 but only interruptions in its magnetization. The magnetization is indicated in the usual way by "N" (north pole) and "S" (south pole), i.e. ring magnet 140 is magnetized diametrally and has an approximately trapezoidal magnetization that, in the context of a ring, enables optimum utilization of the magnetic material. Other types of magnetization are, of course, not precluded. A trapezoidal magnetization is often also referred to as a "rectangular" magnetization, "trapezoidal" and "rectangular" being in this case synonymous to an electrical engineer.

The magnetization of ring magnet 140 is preferably, as depicted, four-pole on both sides. Other numbers of poles are not precluded. But because magnet 92 that is connected to pump wheel 90 has a small diameter, and because it should have the same number of poles as ring magnet 140, numbers of poles exceeding four, or at most six, are difficult to achieve and cause a reduction in the torque that can be transferred by magnetic coupling 93.

Motor 70 is usually a three-phase motor. Its electronic commutation can be controlled by Hall sensors or also by sensing of the voltages induced in the windings, according to the so-called "sensorless" principle. Alternatively, it is also possible to implement motor 70 with only a single winding strand or with two winding strands. Such motors are usually referred to as "single-phase" motors, although they can have only one phase or also two phases. Here again, these are specialized electrical-engineering expressions that are familiar to one skilled in this art.

For secure connection to the plastic of cylindrical portion 78A, ring magnet 140 preferably has a turned-out hollow 142 into which portion 78*a* extends. Magnet 140 can be a so-called plastic-matrix magnet in which hard ferromagnetic particles are arranged in a plastic matrix. With a magnet of this kind, a connection to parts 78*a* and 78*c* can be made particularly easily and securely. Other forms of this magnet are, however, also possible. For example, ring 140 can also be constructed from four individual magnets, in a manner familiar to one skilled in electrical engineering.

Cylindrical portion 78*a* transitions, via a short radial portion 78*b*, into a second cylindrical portion 78*c* that extends to the left parallel to first cylindrical portion 78*a* and at a distance therefrom, and that transitions at its left end via a radial portion 78*d* into the actual fan wheel 80 with its blades 82, and is preferably integral with the fan wheel. Connecting ribs 78*e*, one of which is indicated in FIG. 10, are preferably provided between portions 78*a* and 78*c*.

Figure 11:
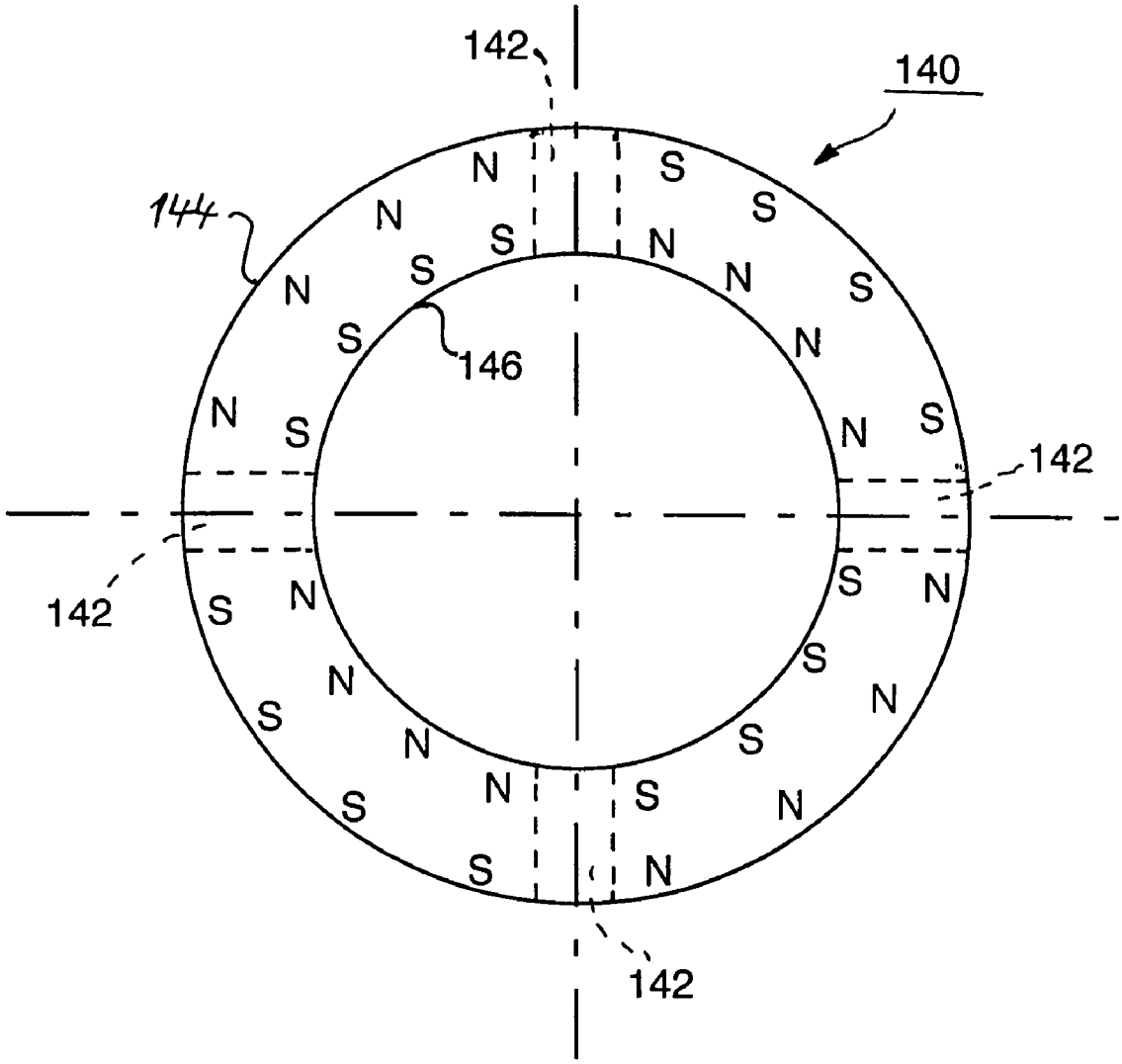
FIG. 11 is an enlarged section viewed along line XI-XI of FIG. 10, but depicting only ring magnet 140 of this arrangement and its preferred magnetization.

Ring magnet 140 extends in an annular space between the inner side of stator 68 and the outer side of partitioning tube 46. In the terminology of electrical engineering, this annular space is also referred to as an "air gap." Outer side 144 (FIG. 11) of ring magnet 140 represents the internal rotor of ECM 70, and its inner side 146 coacts with magnet 92 and with it forms magnetic coupling 93.

It is possible, in this manner, to accommodate a sufficiently large volume of magnetic material in the small air gap between stator 68 and partitioning tube 46. (Be it noted here that FIG. 10 represents a considerable enlargement, which is necessary since the details could not otherwise be depicted.) A comparison with FIG. 9 shows that this is a very advantageous embodiment of the invention, which enables an even more compact design and/or higher power. It must be considered in this context that motor 70 must drive both pump 91 and fan 80, i.e. requires an appropriate power level.

As FIG. 10 symbolically shows by depicting individual parts in gray, partitioning can 52 is by preference implemented integrally with bearing tube 54, retainer 74 for stator 68, a part 36 of the pump housing, struts 32, and tubular part 30 of fan housing 22. This enables simple manufacture and assembly.

Internal magnet 92 of magnetic coupling 93 is connected to a bearing bushing 148 that rotates on the stationary shaft 50; rings 108, 110 serve as axial bearings.

The elimination of a carrier part 62 made of metal, such as the one used in FIG. 1 and FIG. 9, results in a substantial reduction in axial moment of inertia, thus facilitating the startup of such an arrangement and reducing acceleration magnitudes.

Substantial advantages of an arrangement according to the present invention are:

Uncomplicated assembly of fan wheel 80 together with magnets 66, 76 or ring magnet 140.

Uncomplicated balancing of fan wheel 80.

Large-volume stator 68, whose design yields good inherent cooling and high torque.

The entire arrangement can be made very compact.

The entire arrangement can very easily be optimized.

Current can be supplied to the arrangement using known components in simple fashion.

Because small air gaps can be used, inexpensive magnetic materials can be used.

Because an internal rotor is used for drive purposes, rotating masses remain smaller, in principle, than with comparable external-rotor motors. Axial moments of inertia are thereby lower. This allows better dynamics, lower acceleration currents, and in general unproblematic starting behavior with excellent starting reliability.

Noise corresponds approximately to that of a standard axial fan.

Cup-shaped part 62 acts as a damping element, and counteracts the creation of torsional vibrations between pump wheel 90 and its drive magnets 76 or 140. This likewise applies to plastic parts 78*a*, 78*c*, 78*e* of FIGS. 10 and 11.

Although magnet 92 of pump wheel 90 has a small diameter, pump wheel 90 itself can have a larger diameter, so that larger regions of a characteristic curve can also be covered with this design.

Possibilities for mounting on a heat exchanger are not limited. Depending on the design of fan wheel 80, either blowing or drawing operation is possible, i.e. fan 80 either blows cold air into the heat exchanger or draws hot air out of it.

What is obtained, by way of the invention, is therefore a very compact arrangement that requires only one shared electric motor for air cooling and to drive the liquid pump. A cylindrical element (cf. FIG. 5) is located at the center of the assemblage. This element has on one side a cylindrical bearing tube 54 for reception of at least one bearing element 56 of fan wheel 80. Adjoining its other side is partitioning can 52. A trough-shaped annular extension is preferably provided radially outside said partitioning can, and said extension carries stator 68 of ECM 70 as well as, preferably, an associated circuit board 72 on which the control electronics of the ECM are accommodated. Alternatively, this circuit board can also be attached, for example, laterally on fan housing 22.

Many variants and modifications are of course possible, within the scope of the present invention.

The invention claimed is:

1. An arrangement, for conveying fluids, comprising:

a fluid pump (91) implemented as a centrifugal pump, having a pump wheel (90) and a first permanent magnet (92) connected to said pump wheel (90);

an electronically commutated internal-rotor motor (70) having a stator (68), inside which stator is rotatably arranged a rotor (60) that is connected to a second permanent magnet (76; 140) that coacts with the first permanent magnet (92) to serve as a magnetic coupling (93);

a partitioning can (52) that hermetically separates the first permanent magnet (92) of the magnetic coupling (93), which magnet is arranged inside said partitioning can (52), from the second permanent magnet (76; 140), arranged outside the partitioning can (52), the stator (68) of the internal-rotor motor (70) being arranged substantially radially surrounding said magnetic coupling (93).

2. The arrangement according to claim 1, wherein the rotor of the internal-rotor motor (70) is a permanent-magnet rotor (60) forming part of a permanent-magnet arrangement; and said permanent-magnet arrangement (64; 140) is disposed approximately in a common plane with the second permanent magnet (76; 140) of the magnetic coupling (93).

3. The arrangement according to claim 1, wherein the rotor (60) of the internal-rotor motor (70) comprises a carrying part (62) made of a soft ferromagnetic material; and the permanent-magnet arrangement (64) of the rotor and the second permanent magnet (76) of the magnetic coupling (93) are arranged on said carrying part (62).

4. The arrangement according to claim 1, further comprising:

a fan wheel (82) which is connected to the rotor (60) of the internal-rotor motor (70).

5. The arrangement according to claim 4, wherein the rotor (60) of the internal-rotor motor (70) comprises a carrying part (62; 78*a*, 78*c*) on which the rotor (60; 140) is arranged; and the fan wheel (80) is connected to said carrying part (62; 78*a*, 78*c*).

6. The arrangement according to claim 4, wherein the fan wheel is implemented as an axial fan wheel (80).

7. The arrangement according to claim 4, wherein the fan wheel is implemented as a diagonal fan wheel.

8. The arrangement according to claim 4, wherein the fan wheel is implemented as a radial fan wheel.

9. The arrangement according to claim 4, further comprising:

an air-directing housing (22), which surrounds the fan wheel (80) at a radial spacing therefrom, and is connected to the partitioning can (52).

10. The arrangement according to claim 9, wherein the air-directing housing (22) is implemented as a plastic part integral with the partitioning can (52).

11. The arrangement according to claim 10, wherein the partitioning can (52) is connected to the air-directing housing (22) via at least one strut (32).

12. The arrangement according to claim 10, wherein the fluid pump (91) further comprises an outlet fitting (34) which serves as part of a mechanical connection between the partitioning can (52) and the air-directing housing (22).

13. The arrangement according to claim 9, wherein the partitioning can (52) is connected to a wall portion (74) that extends inside the air-directing housing (22) and at a distance therefrom; and the stator (68) of the internal-rotor motor (70) is arranged on said wall portion (74).

14. The arrangement according to claim 1,
wherein
a journaling arrangement (50) for the pump wheel (90) is provided inside the partitioning can (52) on the latter, and
a journaling arrangement (54, 56) for the rotor (60) of the internal-rotor motor (70) is provided outside the partitioning can (52) on the latter.

15. The arrangement according to claim 14, wherein
a stationary shaft (50) for journaling the pump wheel (90) is mounted on the partitioning can (52).

16. The arrangement according to claim 15, wherein an inner region of the pump wheel (90) is penetrated by a supporting member (102) that braces a free end of the stationary shaft (50).

17. The arrangement according to claim 16, wherein
the supporting member (102) serves to minimize axial motions of the pump wheel (90).

18. The arrangement according to claim 1, further comprising:
a bearing tube (54) that is fixedly connected to the partitioning can (52) and serves to journal the rotor (60) of the internal-rotor motor (70).

19. The arrangement according to claim 18, wherein the bearing tube (54) is implemented integrally with the partitioning can (52).

20. An arrangement for conveying fluids comprising:
a fluid pump (91) implemented as a centrifugal pump, which comprises an inflow connector (40) and an outflow connector (34) that are both connected in liquid-tight fashion to a partitioning can (52);
an electronically commutated internal-rotor motor (70) having a stator (68), inside which stator is rotatably arranged a rotor (60) that is drivingly connected via a magnetic coupling (93) to the fluid pump (91), and is connected to a fan wheel (80), the stator (68) of the internal-rotor motor (70) being arranged substantially radially surrounding said magnetic coupling (93); and
an air-directing housing (22) that is arranged around the fan wheel (80), an outlet fitting (34) of the fluid pump (91) forming a mechanical connection between the partitioning can (52) and an air-directing housing (22).

21. The arrangement according to claim 20, further comprising,
in addition to the outlet fitting (34), at least one strut (32) that mechanically connects the air-directing housing (22) to the partitioning can (52).

22. The arrangement according to claim 21,
wherein the partitioning can (52), the strut (32), and the air-directing housing (22) are implemented integrally with one another.

23. The arrangement according to claim 20,
wherein the rotor (60) of the internal-rotor motor (70) comprises an annular permanent magnet (140)
whose outer side (144) coacts with the stator (68) of the internal-rotor motor (70) and
whose inner side (146) coacts with the first permanent magnet (92), thereby serving as a magnetic coupling (93).

24. The arrangement according to claim 23,
wherein the annular permanent magnet (140) is magnetized in an approximately diametrical direction.

25. The arrangement according to claim 24,
wherein the annular permanent magnet (140) has four poles.

26. The arrangement according to claim 24,
wherein the annular permanent magnet (140) has six poles.

27. The arrangement according to claim 23, wherein the annular permanent magnet (140) is connected via a first connecting portion (78*a*) to a hub (126) that in turn is rotatably journaled by means of a shaft (58) connected thereto; and
wherein the annular permanent magnet (140) is drivingly connected via a second connecting portion (78*c*) to a fan wheel (80) of the arrangement.

28. The arrangement according to claim 27,
wherein the first connecting portion (78*a*) and the second connecting portion (78*c*) are interconnected via at least one radially extending connecting element (78*e*).

29. The arrangement according to claim 20,
wherein,
for journaling of the rotor (60) of the internal-rotor motor (70), a bearing tube (54) is provided in which are arranged roller bearings (56) that serve to journal the shaft (58) of the rotor (60), the shaft (58) being displaceable in the axial direction in the inner rings of said roller bearings (56).

30. The arrangement according to claim 29,
wherein there is provided, between one of the roller bearings (56) and a connecting member (126) for connecting the shaft (58) to the internal rotor (60), a securing member (131) which serves to retain at least one of the roller bearings (56), after assembly thereof, in its position in the bearing tube (54); and
there is provided, between one of the roller bearings (56) and the connecting member (126), a spring member (128) that biases the connecting member (126) away from said roller bearing (56).

31. The arrangement according to claim 29,
wherein the connecting member (126) comprises, on its side facing toward the roller bearing (56) adjacent to it, a projection (130) that is implemented for abutment against the holding member (131).

32. The arrangement according to claim 29,
wherein a spacing member (122) is provided between the outer rings of the roller bearings (56).

33. The arrangement according to claim 29,
wherein an enlargement (132), which is adapted for abutment against the inner ring of one of the roller bearings (56), is provided on the shaft (58).

* * * * *